US009627782B2

(12) United States Patent
Fackler

(10) Patent No.: US 9,627,782 B2
(45) Date of Patent: Apr. 18, 2017

(54) CONNECTING ELEMENT

(75) Inventor: Karl-Heinz Fackler, Wemding (DE)

(73) Assignee: Andrew Wireless Systems GmbH, Buchdorf (DE)

( * ) Notice: Subject to any disclaimer, the term of this patent is extended or adjusted under 35 U.S.C. 154(b) by 344 days.

(21) Appl. No.: 13/994,218

(22) PCT Filed: Dec. 13, 2011

(86) PCT No.: PCT/EP2011/006263

§ 371 (c)(1),
(2), (4) Date: Jun. 14, 2013

(87) PCT Pub. No.: WO2012/079738

PCT Pub. Date: Jun. 21, 2012

(65) Prior Publication Data

US 2013/0316576 A1 Nov. 28, 2013

(30) Foreign Application Priority Data

Dec. 16, 2010 (DE) ..... 10 2010 054 801

(51) Int. Cl.

| | |
|---|---|
| ***H01R 9/05*** | (2006.01) |
| ***H01R 13/631*** | (2006.01) |
| ***H01R 24/40*** | (2011.01) |
| *H01R 103/00* | (2006.01) |

(52) U.S. Cl.

CPC ..... *H01R 9/05* (2013.01); *H01R 13/6315* (2013.01); *H01R 24/40* (2013.01); *H01R 2103/00* (2013.01)

(58) Field of Classification Search

CPC ..... H01R 9/05; H01R 2103/00; H01R 24/40; H01R 13/6315

USPC ..... 439/578–585, 246–248, 252, 188

See application file for complete search history.

(56) References Cited

U.S. PATENT DOCUMENTS

| | | | | |
|---|---|---|---|---|
| 3,384,121 | A * | 5/1968 | Spencer | F16K 11/087 137/454.2 |
| 4,697,859 | A | 10/1987 | Fisher, Jr. | |
| 5,516,303 | A * | 5/1996 | Yohn et al. | 439/248 |
| 6,224,407 | B1 * | 5/2001 | Duquerroy et al. | 439/188 |
| 6,354,855 | B2 * | 3/2002 | Annequin | 439/248 |
| 6,383,031 | B1 | 5/2002 | Law et al. | |
| 6,450,829 | B1 * | 9/2002 | Weisz-Margulescu | 439/352 |
| 6,679,726 | B1 * | 1/2004 | Tunn et al. | 439/565 |
| 6,790,046 | B2 * | 9/2004 | Haffenden et al. | 439/6 |

(Continued)

OTHER PUBLICATIONS

International Patent Application No. PCT/EP2011/006263, International Search Report mailed Mar. 9, 2012 (2 pages).

*Primary Examiner* — Jean F Duverne
(74) *Attorney, Agent, or Firm* — Fogg & Powers LLC

(57) ABSTRACT

Connecting element, in particular for an RF application, having a plug part, comprising an internal conductor which extends in the axial direction and an external conductor which surrounds the internal conductor, wherein the internal conductor and the external conductor are shaped at one end of the plug part to form a plug connection, wherein the plug connection can be freely plugged, and the plug part is axially displaceably mounted, as such, in a mounting module and is supported by means of a prestressing means so as to counteract a plugging force. In this case, provision is made for a plate spring to be arranged at the base of the external conductor. A device, in particular for an RF application, having a connecting element of this kind is also specified.

17 Claims, 2 Drawing Sheets

(56) References Cited

U.S. PATENT DOCUMENTS

Figure 1:
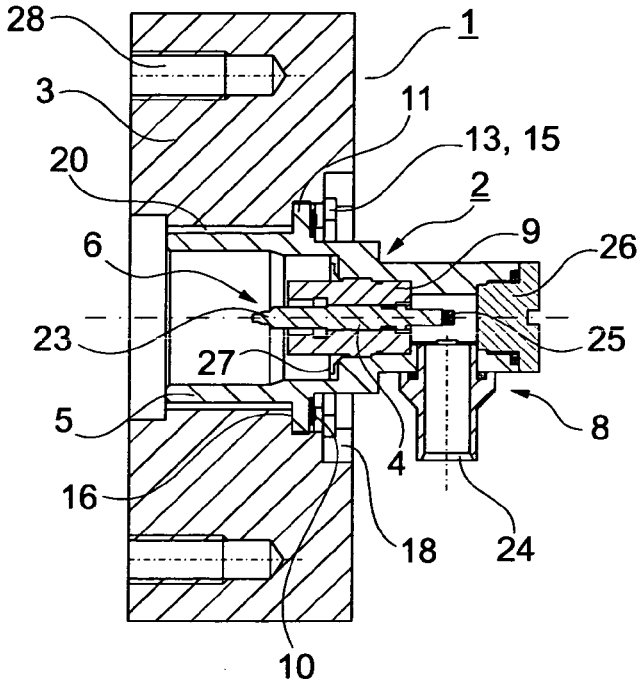

| | | | | |
|---|---|---|---|---|
| 6,827,608 | B2 * | 12/2004 | Hall et al. | 439/578 |
| 6,857,891 | B1 | 2/2005 | Morelli | |
| 7,077,697 | B2 * | 7/2006 | Kooiman | 439/557 |
| 7,399,208 | B2 * | 7/2008 | Schmidt | 439/578 |
| 7,422,456 | B1 * | 9/2008 | Mitani et al. | 439/248 |
| 7,670,175 | B2 * | 3/2010 | Suzuki et al. | 439/578 |
| 7,896,655 | B1 * | 3/2011 | Blasick et al. | 439/63 |
| 8,550,859 | B2 * | 10/2013 | Van Swearingen | 439/660 |
| 2008/0261446 | A1 | 10/2008 | Arnaud | |
| 2010/0233901 | A1 * | 9/2010 | Wild | H01R 13/6277 439/578 |

* cited by examiner

CONNECTING ELEMENT

CROSS-REFERENCE TO RELATED APPLICATIONS

The present application is a national phase of PCT/EP2011/006263, filed Dec. 13, 2011, which claims the benefit of priority to German Patent Application No. 10 2010 054 801.4, filed Dec. 16, 2010, each of which is incorporated herein by reference in its entirety.

The invention relates to a connecting element, in particular an RF connecting element, having a plug part as claimed in the features of the preamble of claim 1. The invention also relates to a device, in particular an RF device, having a connecting element of this kind.

The basic problem with radio-frequency (RF) connections is that dimensions, distances and materials of the individual connecting parts have to be defined in accordance with the frequencies which are to be transmitted and have to be matched to one another. Since, in RF technology, the wavelength lies in the range of the component size, deviations from the defined sizes mean transmission losses which are caused, in particular, by undesired reflections and feedback effects. Therefore, the dimensions and materials of, specifically, releasable RF plug connections are defined and possibly standardized. Known RF plug connectors are, for example, BNC, TNC, C, F, N and QN, QLF or QMA plug connectors. In order to fix the conductors which are to be connected to one another, the known plug connectors have bayonet fittings, screw closures or click closures.

An RF plug connector having a bayonet fitting is known, for example, from U.S. Pat. No. 6,857,891 B1. In said document, a bayonet fitting element is mounted in a prestressed manner on the external conductor as part of this external conductor. Despite the simplified connection technique (bayonet fitting), this results in a more stable connection, with the result that transmission losses are minimized. An axially bent spring ring is disclosed for the purpose of prestressing the bayonet fitting element.

U.S. Pat. No. 6,712,631 B1 describes an electrical plug connector having a screw connection. In said document, the screwed-in external conductor comes into contact with a mating piece, which is supported on a prestressing means, during connection. An axially bent spring ring is again described as the prestressing means in said document.

Connecting elements which are comparable to the type cited in the introductory part are also known from DE 10 2006 021 468 A1, U.S. Pat. No. 4,697,859 A, U.S. Pat. No. 6,224,407 B1 and U.S. Pat. No. 5,944,548 A.

One disadvantage of plug connectors or connecting elements of this type is that they are still comparatively complicated to plug and, in addition, since they are not common, are expensive.

The object of the invention is therefore to specify a connecting element of the type mentioned in the introductory part, in particular which is suitable for RF applications, which exhibits comparatively low transmission losses, can be easily plugged and can be produced in an expedient manner. A further object is to provide a device, in particular an RF device, which can be connected to other components or devices, in particular RF components or devices, with low transmission losses on-site with little expenditure.

For a connecting element having a plug part which comprises an internal conductor which extends in the axial direction and an external conductor which surrounds the internal conductor, wherein the internal conductor and the external conductor are shaped at an end of the plug part to form a plug connection, wherein the plug connection can be freely plugged, and wherein the plug part is axially displaceably mounted, as such, in a holding module and is supported by means of a tensioning means so as to counteract a plugging force, the first-mentioned object is achieved, according to the invention, in that a plate spring is arranged at the base of the external conductor.

In this case, the invention proceeds, in a first step, from the knowledge that the construction of complicated closure elements in the plug connection for positioning the conductors in the inserted state will result in an undesirable increase in the unit price of the plug parts.

In a second step, the invention then proceeds from the consideration not of changing the plug part itself physically in respect of secure positioning, but rather of introducing the plug part as such into a mounting module. This makes it possible to utilize the relative position of the plug part in relation to the mounting module when connection is made in order to define the conductor positions in relation to one another. In other words, the plugging process and the mounting process are separate from one another. As a result, the plug connection itself can be designed in a simple and, in particular, freely pluggable manner, that is to say without additional directly connected mounting steps. The actual mounting is performed in a manner uncoupled and, in particular, remote from the plug part.

In order to fix the conductors in a stable position relative to one another after connection, the invention now makes provision for the plug part to be axially displaceably mounted, as such, in the mounting module and to be supported by means of a prestressing means so as to counteract a plugging force. In other words, the plug part is mounted, as such, in the mounting module in a floating manner. If a complementary plug part is joined to the plug part of the connecting piece, a force acts against the prestressing means, this resulting in a corresponding restoring force. The plug part is axially displaced in relation to the mounting module with deformation of the prestressing means at the latest when the plate spring is reached by the corresponding contour of the complementary plug part.

The external conductor of the complementary plug part presses against the plate spring and is electrically contact-connected to the external conductor of the plug part by means of said plate spring. In other words, the plug part is displaced in the axial direction in the mounting module until the forces are compensated for. The axial distances of the external conductors and of the internal conductors are predefined. The connecting element is finally mounted in relation to the complementary plug part by means of the mounting module.

In the fitted state of the mounting module, the plug part is pressed against the prestressing means by the complementary plug part stopping against a spring element of this kind. The plug part is ultimately prestressed against the complementary plug part in an axially displaceable manner on account of compression of the prestressing means. Vibration, agitation or a change in temperature of the used materials in relation to one another does not lead in this respect to a change, which is undesired because it causes losses, in the position of the plugs in relation to one another, but instead is also compensated for by the prestressing means. Furthermore, manufacturing tolerances are also compensated for by the prestressing means at the same time.

The plug parts which are mounted in a floating manner in the mounting module can already be pre-configured on the connection side. On account of the plug connection being of freely pluggable design, connection is performed in a simple and quick manner, specifically merely by insertion, on-site. In principle, the mounting module can be connected to the complementary plug or plugs in any desired manner, for example by a screw or clamping connection. Alternatively, a snap-action, lever, clamping, click or latching connection is provided. To this end, the connection only has to ensure that the mounting module is held in position in relation to the complementary plug part. In any case, complicated reconfigurations of the plug parts themselves are not necessary for connecting the mounting module. Moreover, the mounting module can also be connected remote from the actual plug connection, in particular in places where it is more easily accessible. To this end, the complementary plug parts can be, for example firmly, fitted in a correspondingly designed connection module. The connection module and the mounting module are then connected to one another after plug connection, which is simple because it is free, has been performed.

In a preferred refinement of the invention, the mounting module is designed in such a way that the plug part is moved out of its inoperative position and mounted in a prestressed manner in a finally fitted state. This refinement makes it possible to set the prestressing force by defined deformation of the prestressing means in the installed or finally fitted state by dimensioning the mounting module. In other words, when the mounting module is connected, the prestressing means is deformed in a defined manner by means of the resulting offset of the plug part, this directly producing the magnitude of the prestressing force. In this way, the manufacturing-related tolerances of the dimensions of the components can also be taken into consideration.

The prestressing means can be supported on the mounting module, in principle, in a manner which is known per se. In one expedient refinement, the plug part is supported against a rear stop face of the mounting module by means of the prestressing means. The rear stop face is provided, for example, in the form of a collar, in the form of a recess, in the form of a break in the radius, in the form of a pin or the like. In a further advantageous refinement, the external conductor comprises a collar for this purpose, the plug part being supported against the rear stop face of the mounting module by means of said collar.

It is recommended that a suitable securing means be provided in order to captively mount the plug part in the mounting module. A securing means of this kind has, for example, an engagement means which prevents the plug part from falling out at the front, that is to say in the direction of the plug connection. In one expedient refinement, the collar of the external conductor is braced against a front stop face of the mounting module in the direction of the plug connection for this purpose. A further offset of the plug part in this direction is not possible. Therefore, the plug part is reliably prevented from falling out. The front stop face can also be in the form of a collar, in the form of a break in the radius, in the form of a recess, in the form of a pin or the like.

The prestressing means preferably also presses the collar of the external conductor forward against the front stop face of the mounting module in a pre-fitted state. The plug part is therefore mounted on the mounting module in a secure and stable manner.

For simple fitting, the rear stop face of the mounting module is formed by a retaining ring, which is inserted into a corresponding groove, in one advantageous development of the connecting element. The plug part is inserted into the holding module by way of the plug connection beforehand for fitting purposes. The prestressing means is then inserted and finally the retaining ring is fitted as a rear stop face. The plug part is therefore supported at the rear against the retaining ring by means of the prestressing means. The retaining ring is preferably produced from a copper/beryllium alloy and has a thickness of only a few 1/10 mm.

According to a first variant, the prestressing means is provided by an elastically deformable piece of material. The restoring or prestressing force is then produced by deformation of the material or its attempts to return to the starting position. In particular, the prestressing means can be of spring-elastic design.

Accordingly, it exhibits a characteristic dependency of the prestressing force on the path of the deformation. Examples of suitable spring-elastic prestressing means are a spiral spring or helical spring. In order to obtain a sufficiently high restoring force with a comparatively simple geometry, the prestressing means is, however, expediently provided in the form of a spring ring. In this case, the spring ring is formed, in particular, as a plate spring with a conical convexity in the axial direction. The spring ring can also be severed in the circumferential direction and be designed with ring ends which are axially offset in relation to one another. In a particularly advantageous variant embodiment, the spring ring is inherently corrugated, wherein the amplitude of the corrugation is axially oriented. The material used for the spring ring is preferably a spring steel, in particular stainless spring steel.

The ability to axially displace the plug part in the mounting module is expediently provided by a sliding bearing. To this end, the plug part is inserted into a hole in the mounting module with the external conductor being at a radial distance in a simple and cost-effective and therefore preferred refinement.

In a further expedient variant, the plug part, at that end which is averted from the plug connection, has a freely accessible connection element for connecting a coaxial cable to the internal conductor and to the external conductor. In this case, the connection element expediently projects out of the mounting module. The conductors of the plug part and of the coaxial cable can then be connected by means of a known connecting technique, such as in particular soldering or screwing. The connecting element provides the simple option of pre-assembly in this respect. The connecting element which is provided with coaxial cables is then connected, for example, to a connection side of a device, in particular an RF device, in a comparatively simple manner on-site.

In order to allow the mounting module to be fitted and connected in a simple manner, the plug connection of the plug part is advantageously recessed into the mounting module. The mounting module can then be, for example, in the form of a plate which is then easily fitted to a connection wall of a device. In this case, the complementary plug parts, which form, in particular, a passage into the interior of the device, are mounted in the connection wall of the device.

The external conductor in the region of the plug connection is preferably in the form of a socket and the internal conductor is in the form of an insertion tip. Since the external conductor of the complementary plug part engages in the interior of the socket, this is the structurally simpler variant. There is no need to provide any space for engagement of the complementary plug part between the external conductor and the mounting module.

A further advantage of the connecting element is achieved by a plurality of plug parts being mounted in the mounting module as described above. In this way, it is possible to connect the plug parts to corresponding arranged firmly fitted complementary plug parts in a single simple free plugging process. The mounting module itself is then fitted. The plug parts are prestressed against the complementary plug parts and as a result fixed in their position.

The second-mentioned object is achieved, according to the invention, by a device, in particular by an RF device, which comprises a connection module and a connecting element of the above-described type which is connected to said connection module. In this case, a number of complementary plug parts to which the plug parts of the connecting element are plug-connected in a prestressed manner in each case are firmly fitted in the connection module.

In this respect, it is clear that the above-described connecting element provides a simple and cost-effective way of connecting devices, and in particular RF devices, to one another. The correspondingly provided complementary plug parts and plug parts of the connecting element are freely inserted one into the other. The connection module and the mounting module are then fitted to one another, possibly remote from the plug parts. This can be performed, for example, by a simple and stable screw connection.

In a further preferred refinement, the connection module and the mounting module are produced from materials with matched coefficients of thermal expansion. This ensures that the position of the conductors of the plug parts relative to one another remains unchanged at different temperatures. However, the position of the plug parts in relation to one another at different temperatures could also vary only when the differences in travel provided by a different extent reduce the prestressing force which is provided by the prestressing means to an impermissible extent.

In this context, matched coefficients of thermal expansion means that the coefficients of thermal expansion do not differ from one another by more than is predefined by a defined setpoint value within the temperature range which is predefined for the use. In the simplest case, the materials are identical. In this case, suitable pairs of materials are selected from amongst the group comprising aluminum, magnesium, brass, bronze, zinc, austenitic steel and alloys of these.

The invention provides the major advantage of using RF plug parts which are commercially available. Therefore, the plug parts used can be the known QN, QLF or QMA plugs. However, the click or latching connection which is still required for these plugs is dispensed with here. The above-described connecting element can be freely plugged.

Figure 2:
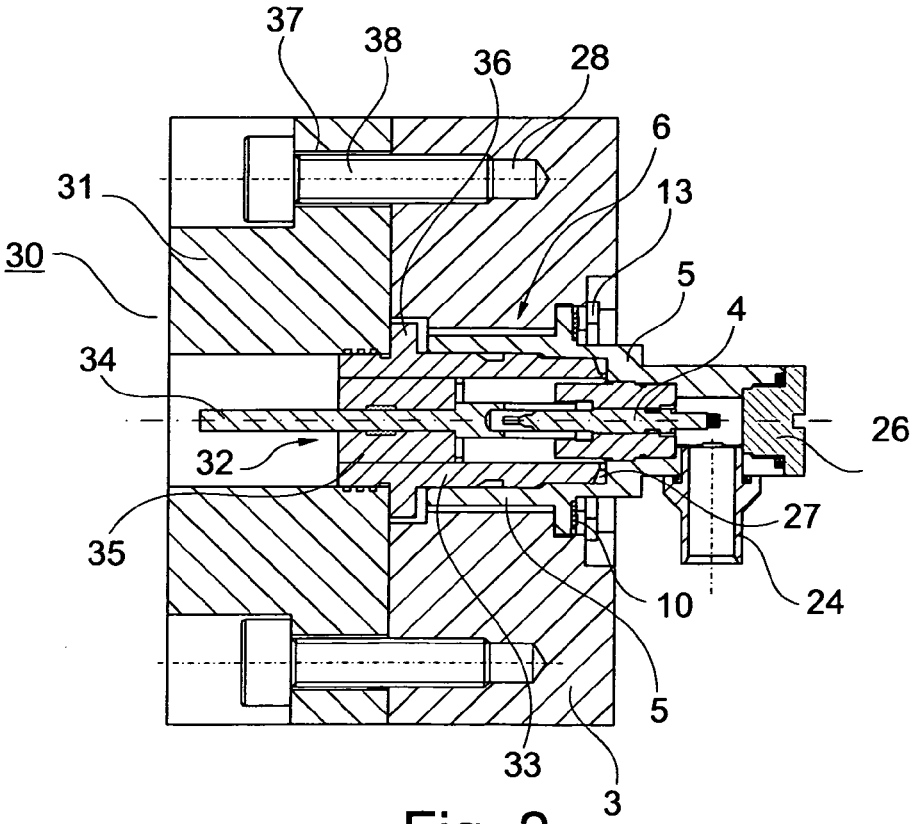
Figure 3:
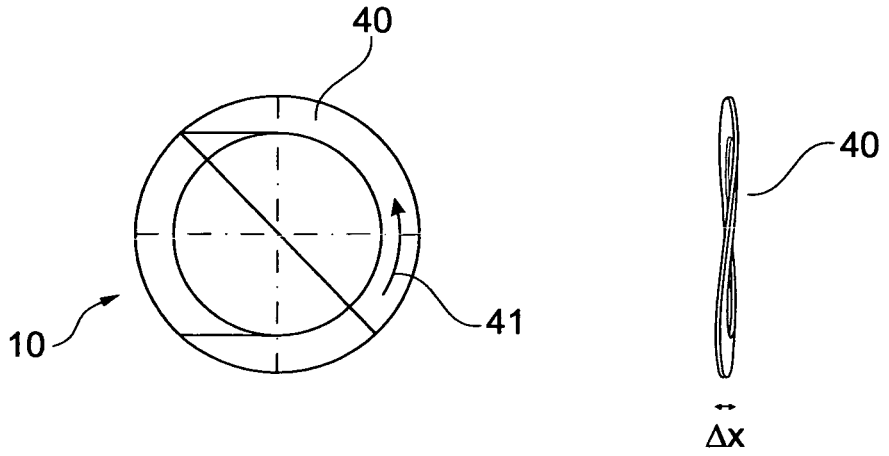
Figure 4:
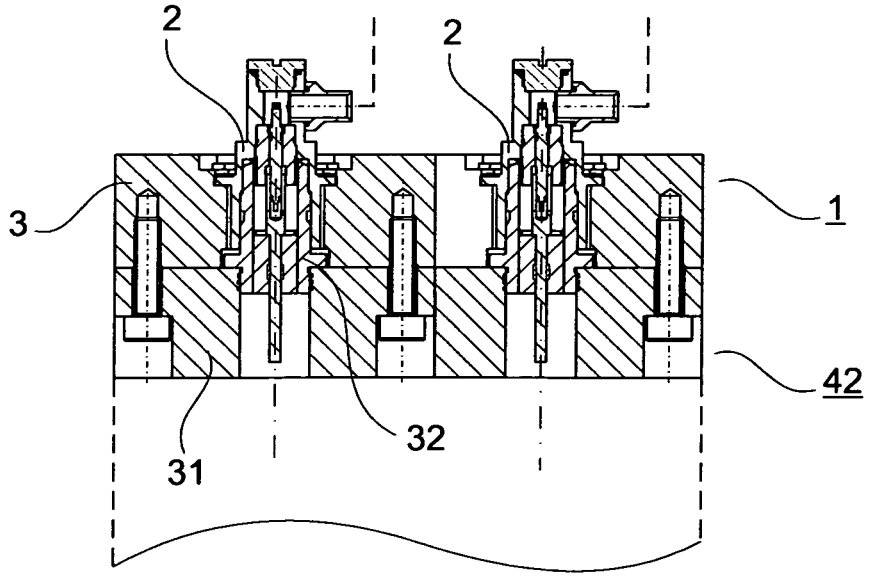

Exemplary embodiments will be explained in greater detail with reference to the drawing, in which:

FIG. 1: shows a cross section through a connecting element having a plug part which is mounted in a mounting module in a floating manner, FIG. 2: shows a cross section through a device having a connecting element according to FIG. 1 which is screwed to a connection module, FIG. 3: shows a plan view and a side view of a spring ring for prestressing the plug part which is mounted in a floating manner, and FIG. 4: shows a further device having a connection module and a mounting module, which is mounted on said connection module and has two plug parts which are mounted therein in a floating manner.

FIG. 1 shows a cross section through a connecting element 1 for an RF connection having a plug part 2 and a mounting module 3. The plug part 2 comprises an internal conductor 4 and also an external conductor 5 which surrounds the internal conductor 4. The internal conductor 4 and the external conductor 5 are shaped at one end of the plug part 2 to form a plug connection 6.

The plug connection 6 is designed to receive a corresponding complementary plug part. The other end of the plug part 2 is shaped in the form of a connection piece 8 for connecting a coaxial cable. The internal conductor 4 and the external conductor 5 are electrically insulated from one another and fixed to one another by an insulating piece 9 in the plug part 2.

The plug part 2 is mounted in the mounting module 3 in a floating manner on the whole. The plug connection 6 of the plug part 2 is arranged in the interior of the mounting module 3 in a recessed manner. The connection piece 8 projects beyond the mounting module 3 and is freely accessible.

The plug part 2 is inserted into a continuous, correspondingly contoured hole in the mounting module 3. In this case, a radial distance 20 remains between the external conductor 5 and the inner wall of the mounting module 3. In the shown position, the plug part 2 can be axially displaced to the right in relation to the mounting module 3. A prestressing means 10 is also provided, said prestressing means being introduced between a circumferential collar 11 of the external conductor 5 and a rear stop face 15 of the mounting module 3 in an axial direction. The rear stop face 15 of the mounting module 3 is provided by a detachable retaining ring 13 which is inserted into a groove in the mounting module 3.

In order to fit the connecting element 1, the plug part 2 is introduced, from the right, into the contoured hole in the mounting module 3 until the collar 11 of the external conductor 5 touches the front stop face 16 of the mounting module 3. The prestressing means 10 is then inserted and prestressed against the mounting module 3 by means of the retaining ring 13. In this case, correspondingly notches are made on the rear face of the mounting module 3 in order to fit and to remove the retaining ring 13.

In the fitted state, the plug part 2 is, overall, prestressed at the front in the direction of the plug connection 6. The collar 11 is supported against the front stop face 16 of the mounting module 3. The prestressing force which is directed toward the front is produced by the compression of the prestressing means 10 between the collar 11 and the retaining ring 13.

The plug connection 6 of the plug part 2 is in the form of a socket 22 with respect to the external conductor 5. The internal conductor 4 is shaped on the side of the plug connection 6 to form an insertion tip 23. The freely accessible connection piece 8 comprises a cable shoe 24 which serves to establish contact between the external conductor 5 and the external conductor of a coaxial cable. In the event of contact being established, the internal conductor of the coaxial cable is guided and connected to the soldering tip 25 of the internal conductor 4 in the interior of the cable shoe 24. A screw cap 26 is provided on the connection piece 8 in order to carry out the soldering work and to monitor the soldering contact.

Overall, the plug part 2 is mounted, as such, in the mounting module 3 in a floating manner at a radial distance 20. The plug part 2 is prestressed against a plugging force by a complementary plug and mounted in the mounting module 3 in an axially displaceable manner.

In order to establish a plug connection with a complementary plug part, the entire connecting element 1 is plugged onto the complementary plug part. A plate spring 27 is arranged at the base of the socket 22, which is formed by the external conductor 5, in the interior of the plug connection 6. The plug part 2 is axially displaced in relation to the mounting module 3 with deformation of the prestressing means 10 at the latest when said plate spring 27 is reached by the corresponding contour of the complementary plug part. The mounting module 3 is then fitted to the complementary plug part while maintaining the prestress or the axial displacement of the plug part 2.

In the fitted end state, the shown plug part 2 remains displaced axially out of its inoperative position with the build-up of prestress in the mounting module 3. In the event of agitation or vibration, the plug part 2 does not change position in relation to the complementary plug part on account of the prestressing force received. Manufacturing tolerances in the dimensions are compensated for by means of the plug part 2 being mounted in a floating and prestressed manner. The plug part 2 and the complementary plug part, for example shown in FIG. 2, reference sign 32, remain in a stable fixed position in relation to one another.

Therefore, a connecting element for an RF connection, which connecting element exhibits a simple connection technique, specifically free plugging, is specified overall. On account of the plug part 2 as such being mounted in a floating and prestressed manner in a mounting module 3, the positions of the plug part 2 and the complementary plug part in relation to one another are maintained independently of manufacturing tolerances and independently of agitation, vibration or the like. In this respect, the connecting element 1 according to FIG. 1 shows a clearly improved transmission characteristic for high-frequency voltage or current signals.

In the present case, the mounting module 3 is in the form of a plate. Threaded holes 28 are provided remote from the actual plug connection 6 for fitting purposes. The threaded holes 28 can be used to fit the mounting module 3, for example, to a connection plate of an RF device in which the corresponding complementary plug parts are firmly fixed. As an alternative to a screw connection, a snap-action, lever, click, latching or clamping connection is provided in order to hold the mounting module 30 in position in relation to the complementary plug part.

FIG. 2 shows a cross section through a correspondingly equipped device 30. Said device 30 can be, for example, an antenna amplifier or the like. The device 30, not illustrated in any more detail, has a plate-like connection module 31 in which a complementary plug part 32 is firmly fitted. In the present case, the complementary plug part 32 is screwed into the connection module 31.

The complementary plug part 32 likewise has an external conductor 33 and an internal conductor 34. The external conductor 33 and the internal conductor 34 are insulated from one another and fixed by an insulating piece 35. The external conductor 33 has a circumferential collar 36 as the stop face of the complementary plug part 32 on the connection module 31.

The external conductor 33 of the complementary plug part 32 is in the form of an insertion socket which can be introduced into the socket 22 of the plug part 2. The end of the internal conductor 34 is in the form of a socket in which the insertion tip 23 of the internal conductor 4 of the plug part 2 engages in the plugged state.

According to FIG. 2, the plug connection is established between the plug part 2 and the complementary plug part 32. In this case, both the external conductors 5, 33 and the internal conductors 4, 34 of the two plug parts 2, 32 are electrically contact-connected to one another. The external conductor 33 presses on the plate spring 27 and is electrically contact-connected to the external conductor 5 by means of said plate spring. The insertion tip 23 of the internal conductor 4 engages in the socket-like receiving end of the internal conductor 34. The axial distances of the external conductors 5, 33 and the internal conductors 4, 34 are predefined by the specific contouring of the plug shapes and, in particular, by the external conductor 33 stopping against the plate spring 27.

During the process of plugging the connecting element 1 onto the connection module 31 of the device 30, the plug part 2 experiences an axial displacement to the right against the restoring force of the prestressing means 10. In this state, the connection module 31 and the mounting module 3 make contact. The connection module 31 and the mounting module 3 are screwed by means of the screws 38 which are routed into holes 37. Therefore, the plug part 2 is prestressed against the complementary plug part 32 in the fitted state.

The internal conductor 34 is routed into the interior of the device 30 and accordingly contact can be made with it or it can be wired up there. The internal conductor 34 or the corresponding complementary plug 32 are firmly fitted to the connection module 31 and therefore to the device.

The materials of the connection module 31 and the fastening module 3 are matched to one another in respect of their coefficients of thermal expansion. The coefficients of thermal expansion are equal within the temperature range which is provided for operation. The mounting module 3 and the connection module 31 are produced from aluminum. The voltage-carrying parts of the complementary plug part 32 and the plug part 2 are produced from bronze or from brass. The insulating bodies 9, 35 are composed of polytetrafluoroethylene. The retaining ring 13 is composed of a copper/beryllium alloy.

The prestressing means 10 according to the variant embodiments according to FIGS. 1 and 2 is designed as a spring ring 40, as shown in FIG. 3. According to the plan view in FIG. 3, the spring ring 40 is inherently closed in the manner of a circle. The spring ring 40 is corrugated with an axial amplitude (not shown here) in the circumferential direction 41. This axial deflection $\Delta x$ can be seen in the plan view which is illustrated on the right-hand side of FIG. 3. In other words, the spring ring 40 is inherently twisted with an axial amplitude. The material selected for the spring ring 40 is a steel, in particular a spring steel, preferably a stainless spring steel.

In the state free of stress, the axial deflection $\Delta x$ of the spring ring 40 is such that the plug part 2 is pressed slightly against the front stop face 16 of the mounting module 3 by way of the circumferential collar 11 of the external conductor 5. The spring ring 40 is compressed during the plugging process and in the finally fitted state according to FIG. 3. The axial amplitude $\Delta x$ of the spring ring 40 has reduced.

FIG. 4 once again illustrates a cross section through a connecting element 1, wherein, in contrast to FIG. 1, a total of two plug parts 2 are mounted in a mounting module 3 in a floating and axially prestressed manner. The design of the mount for the plug parts 2 in the mounting module 3 is identical to FIG. 1 in this case.

The connecting element 1 shown in FIG. 4 is provided to make contact with a further device 42, wherein two high-frequency lines are routed into the interior of the device. The device 42 accordingly has a connection module 31 to which two complementary plug parts 32 are firmly screwed.

For fitting purposes, the mounting module 3, including the plug parts 2 which are mounted therein in a floating manner, is initially freely mounted on the connection module 31 of the device 42. In this case, the plug connection between the two plug parts 2 and the respective complementary plug parts 32 is established with the mounting module 3 and the connection module 31 gradually coming closer. The mounting module 3 and the connection module 31 are screwed with a slight axial offset of the plug parts 2 and therefore in a prestressed manner.

It can be seen that RF devices 30, 41 can be connected in a simple manner with free plugging by means of the indicated connecting element 1. On account of the indicated floating and prestressed mounting of the plug parts 2 in the mounting module 3, it is additionally possible to design a stable plug connection which is fixed in position and exhibits a low level of loss in power. The plug parts 2 and complementary plug parts 32 employed can be known and commercially available plugs such as QN, QLF or QMA plugs. The click or latching closure which is provided for plugs of this kind is dispensed with.

LIST OF REFERENCE SYMBOLS

1 RF connecting element
2 Plug part
3 Mounting module
4 Internal conductor
5 External conductor
6 Plug connection
8 Connection piece
9 Insulating piece
10 Prestressing means
11 Collar
13 Retaining ring
15 Rear stop face
16 Front stop face
18 Notch
20 Distance
22 Socket
23 Insertion tip
24 Cable shoe
25 Soldering tip
26 Screw cap
27 Plate spring
28 Threaded hole
30 RF device
31 Connection module
32 Complementary plug
33 External conductor
34 Internal conductor
35 Insulating piece
36 Collar
37 Hole
38 Screw
40 Corrugated spring ring
41 Circumferential direction
42 RF device
Δx Axial deflection

The invention claimed is:

1. A connecting element for RF, the connecting element comprising:

a plug part axially displaceably mounted in a mounting module and supported by a prestressing means for counteracting a plugging force;

an internal conductor that extends in an axial direction;

an external conductor that surrounds the internal conductor, wherein the internal conductor and the external conductor are shaped at an end of the plug part to form a plug connection; and a plate spring arranged within the external conductor to encircle the internal conductor at a base of the external conductor.

2. The connecting element of claim 1, wherein the mounting module is configured for allowing the plug part to move out of an inoperative position and to be mounted in a prestressed manner in a finally fitted state.

3. The connecting element of claim 1, wherein the plug part is supported against a rear stop face of the mounting module by the prestressing means.

4. The connecting element of claim 3, wherein the external conductor includes a collar by which the plug part is supported against a rear stop face of the mounting module.

5. The connecting element of claim 4, wherein the collar is braced against a front stop face of the mounting module, in a direction of the plug connection.

6. The connecting element of claim 4, wherein the rear stop face is formed by a retaining ring inserted into a groove in the mounting module.

7. The connecting element of claim 1, wherein the prestressing means includes a spring ring.

8. The connecting element of claim 7, wherein the spring ring is corrugated.

9. The connecting element of claim 1, wherein the plug part is inserted into a hole in the mounting module with the external conductor being at a radial distance.

10. The connecting element of claim 1, wherein the plug part, at an end that is averted from the plug connection, includes an accessible connection element for connecting a coaxial cable to the internal conductor and to the external conductor.

11. The connecting element of claim 1, wherein the plug connection is recessed into the mounting module.

12. The connecting element of claim 1, wherein the external conductor is a socket, wherein the internal conductor is an insertion tip.

13. The connecting element of claim 1, wherein the mounting module includes a plurality of screw-connection means.

14. The connecting element of claim 1, wherein a plurality of plug parts is mounted in the mounting module.

15. A device for RF, the device comprising:

a connection module that includes a plurality of complementary plug parts; and a connecting element connected to the connection module, the connecting element including:

a plurality of plug parts plug-connected in a prestressed manner to the plurality of complementary plug parts, each plug part being axially displaceably mounted in a mounting module and supported by a prestressing means for counteracting a plugging force;

an internal conductor that extends in an axial direction;

an external conductor that surrounds the internal conductor, wherein the internal conductor and the external conductor are shaped at an end of the plurality of plug parts to form a plug connection; and a plate spring arranged within the external conductor to encircle the internal conductor at a base of the external conductor.

16. The device of claim 15, wherein each plug part includes connection elements that are connected by coaxial cables.

17. The device of claim 15, wherein the connection module and the mounting module are made from materials with a respective matched coefficient of thermal expansion.

* * * * *